US005794094A

United States Patent [19]

Boockholdt et al.

[11] Patent Number: 5,794,094

[45] Date of Patent: Aug. 11, 1998

[54] ACCURATE TONER LEVEL FEEDBACK VIA ACTIVE ARTIFICIAL INTELLIGENCE

[75] Inventors: Darius Boockholdt, Eagle; Howard G. Hooper, Boise, both of Id.

[73] Assignee: Hewlett-Packard Company, Palo Alto, Calif.

[21] Appl. No.: 852,886

[22] Filed: May 8, 1997

[51] Int. Cl.[6] ..... G03G 15/08

[52] U.S. Cl. ..... 399/27; 399/42

[58] Field of Search ..... 399/24, 27, 28, 399/38, 42, 43, 49

[56] References Cited

U.S. PATENT DOCUMENTS 5,160,966 11/1992 Shiina et al. ..... 399/27

5,327,196 7/1994 Kato et al. ..... 399/42 X 5,655,174 8/1997 Hirst ..... 399/27

5,699,096 12/1997 Inagaki ..... 399/42 X 5,724,627 3/1998 Okuno et al. ..... 399/27

*Primary Examiner*—Sandra L. Brase

[57] ABSTRACT

A toner detecting system includes an image forming apparatus having a toner reservoir. A toner sensor of the system has a toner sensing element positioned to detect toner amount within the toner reservoir. A pixel counter of the system is configured to count pixels used when forming images. A processor of the system associates counted pixels with previous toner use. The associated counted pixels and previous toner use cooperate to enable enhanced toner level characterization of remaining available toner level. A method for detecting toner level within a toner-reservoir of an image forming device according to the toner detecting system is also disclosed.

20 Claims, 4 Drawing Sheets

ACCURATE TONER LEVEL FEEDBACK VIA ACTIVE ARTIFICIAL INTELLIGENCE

FIELD OF THE INVENTION

This invention relates generally to image forming apparatus such as printers, and more particularly to systems for enhancing the detection of toner level within an image-forming apparatus.

BACKGROUND OF THE INVENTION

A typical image-forming apparatus such as a printer or a copier that uses electrophotographic, ionographic, or magnetographic technologies frequently uses powder toner development of an intermediate image created in the forming process. With any of these image-forming technologies, a supply of powder toner is stored in a toner reservoir from which it is delivered via a developer roll and metering blade to a photoconductor drum.

For the case of electrophotographic printing, a photoconducting drum is first electrostatically charged; the photoconductor drum is then exposed to the image light pattern, which selectively discharges regions on the previously charged drum; the photoconductor drum is developed by delivering electrostatically charged toner particles to the surface of the drum where the charged particles selectively adhere to appropriately charged regions; the electrostatically transferred toner image on the drum is transferred to the paper (or other carrier medium); the toner is thermally fused to the paper; and any residual toner is cleaned from the surface of the photoconductor drum prior to reinitiation of the process. Such a process is applicable for write-black printers as well as write-white printers.

According to the above steps, the delivery of powder toner to the photoconductor drum is referred to as development. Two different development techniques utilize powder toner; namely, a dual component and a mono component development technique. The dual component technique was most commonly utilized prior to the advent of electrophotographic printers designed for personal and work station computer use. However, the technique is still found in high-end printers. This technique requires the use of toner particles and carrier beads which must be provided in a supply reservoir. The other technique, referred to as mono component development, is used almost exclusively for low-end printers because the use of carrier beads is not required. However, both such systems utilize powder toner, which is usually provided in a replaceable toner/developer cartridge. Hence, powder toner is usually supplied via a toner reservoir.

With both development techniques, there is a need to enhance the ability to accurately sense the level of toner available within a toner reservoir for use by an image developing device. By more accurately sensing available toner level, a user can monitor and/or better predict the level of available toner and the available printing life, respectively. However, there is also a need to sense accurate toner levels with sensing systems that are relatively low in overall cost. One previously utilized technique of sensing available toner level on a printer has been implemented in the form of an antenna. According to this technique, a metal rod is positioned to run parallel with a development sleeve in a toner reservoir at a distance of about five millimeters. The metal rod couples with an electrical field that is generated by an alternating current-induced electrical bias of the development sleeve. Associated circuitry is also provided to sense the change in field strength resulting from decreases in toner level between the rod and the sleeve. Such a system proves relatively inexpensive, but is only capable of sensing toner at, or near, the end of life for a toner cartridge. Typically, such a system is only capable of sensing end of life for a toner cartridge when less than five percent of the toner still remains within the cartridge. Additionally, the antenna is required to remain adjacent, or near, the development sleeve or else signal strength is lost when the antenna is positioned distal, or further away, from the development sleeve.

An alternative technique for sensing toner level involves the use of an optical system in the form of emitter and detector pairs that have been configured to optically sense the presence of toner within a toner supply reservoir. Such a technique requires the use of a viewing window and a wiper, the wiper being used to frequently clean toner from the window. The emitter and detector pairs are used to detect the presence of toner via the window. However, the optical sensor of such a system is typically only capable of measuring and reporting toner levels in coarse 20% increments. For example, toner levels of 100%, 80%, 60%, 40%, and 20% can be detected.

Yet another alternative technique involves attempts to count pixels used to create bit images and pixel images by a laser of a laser printer. However, attempts to accurately quantify pixel use with the amount of toner available to a user have proved inaccurate. Calibration of pixel use relative to available toner has produced results that tend to drift, resulting in inaccuracies, and an inability to accurately monitor the level of toner available to a user.

Both of the above-mentioned sensing systems are capable of detecting the presence of toner. However, as toner capacity has increased and printers have been put on networks, the accurate monitoring of available toner level in order to predict available toner has become an important consideration in the management of printer performance. Hence, there is a need to improve toner level sensing particularly near the end of life for a toner cartridge as the level of available toner becomes diminished, yet do so cost effectively. Armed with such information, predictions can be made as to when a cartridge must be changed/replenished, and how much page printing capacity remains for the remaining available toner.

SUMMARY OF THE INVENTION

It is therefore an object of the present invention to overcome the above deficiencies and disadvantages of the prior art and to provide enhanced toner level sensing for use with image-forming apparatus, the toner level sensing including a toner sensor having capabilities to roughly measure toner levels, and pixel counting toner level monitoring enhancement features that enable more accurate monitoring of toner level.

According to one aspect of the invention, there is provided a toner level detecting system for an image forming apparatus having a toner reservoir. The detecting system has a toner sensor with a toner sensing element positioned to detect toner amount within the toner reservoir. The detecting system also has a pixel counter configured to count pixels used when forming images. Furthermore, the system has a processor associating counted pixels with previous toner use, the associated counted pixels and previous toner use enabling enhanced toner level characterization of remaining available toner level.

According to another aspect of the invention, there is provided a printing device having an electrostatic image-carrying device for carrying a latent image. The printing device also includes a developing unit for developing the latent image. Even further, the printing device includes a toner supply reservoir for supplying toner. Yet even further, the printing device includes a toner level detecting system including an image forming apparatus having a toner reservoir, a toner sensor having a toner sensing element positioned to detect toner amount within the toner reservoir, a pixel counter configured to count pixels used when forming images, and a processor associating counted pixels with previous toner use, the associated counted pixels and previous toner use enabling enhanced toner level characterization of remaining available toner level.

According to yet even another aspect of the invention, there is provided a method for detecting toner level within a toner reservoir of an image forming device. The method includes the steps of: providing a toner sensor within a toner reservoir of an image forming apparatus; incrementally detecting toner amount within the toner reservoir via the toner sensor; counting pixels used to form images with a determined amount of toner removed from the toner reservoir; and calculating toner amount by adjusting the incrementally detected toner amount with an estimated amount of removed toner based at least in part on the number of counted pixels.

Other objects, features and advantages of the invention will become apparent in the following specification and accompanying drawings.

BRIEF DESCRIPTION OF THE DRAWINGS

FIG. 5 is a simplified schematic diagram of an artificial intelligence model in the form of a neural network toner usage classifier for a three layer, backpropagation network.

DETAILED DESCRIPTION OF THE PREFERRED EMBODIMENT

This disclosure of the invention is submitted in furtherance of the constitutional purposes of the U.S. Patent Laws "to promote the progress of science and useful arts". U.S. Constitution, Article 1, Section 8.

Figure 1:
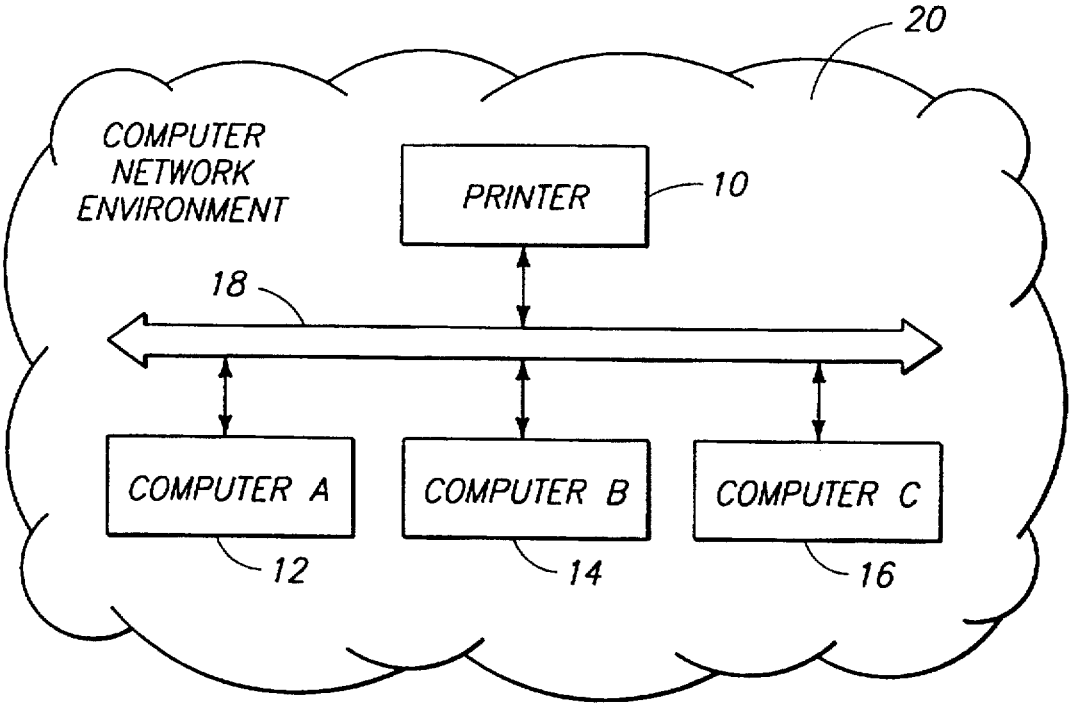
FIG. 1 is a high level schematic block diagram of a network operating environment having a printer that is adapter to carry out the apparatus and method of the invention.

FIG. 1 illustrates an image-forming apparatus in the form of an electrophotographic printing device, or printer, 10 for depositing laser generated images onto a piece of paper. In another configuration, the image-forming apparatus is a plain paper copier. Laser printer 10 is shown in a multiple user configuration wherein several computers 12, 14 and 16 are connected with printer 10 via an array of connections in the form of a network bus 18 of a computer network environment 20. As shown, computer network environment 20 is in the form of a local area network. Computers 12, 14 and 16, and printer 10 can be connected together via JETADMIN™ LAN ethernet connections, available from Hewlett-Packard. Preferably, corresponding hardware includes a JetDrive™ multiprotocol EIO, an ethernet card that spools out print jobs from the network, available from Hewlett-Packard. Any one of computers 12, 14 and 16 can send a print job to printer 10 with each printer having a printer driver (not shown) for formatting a print job for delivery to printer 10. Printer 10 is configured to use Hewlett-Packard's PCL™ (Printer Control Language). Additionally, printer 10 includes a Hewlett-Packard PCL Formatter.

Figure 2:
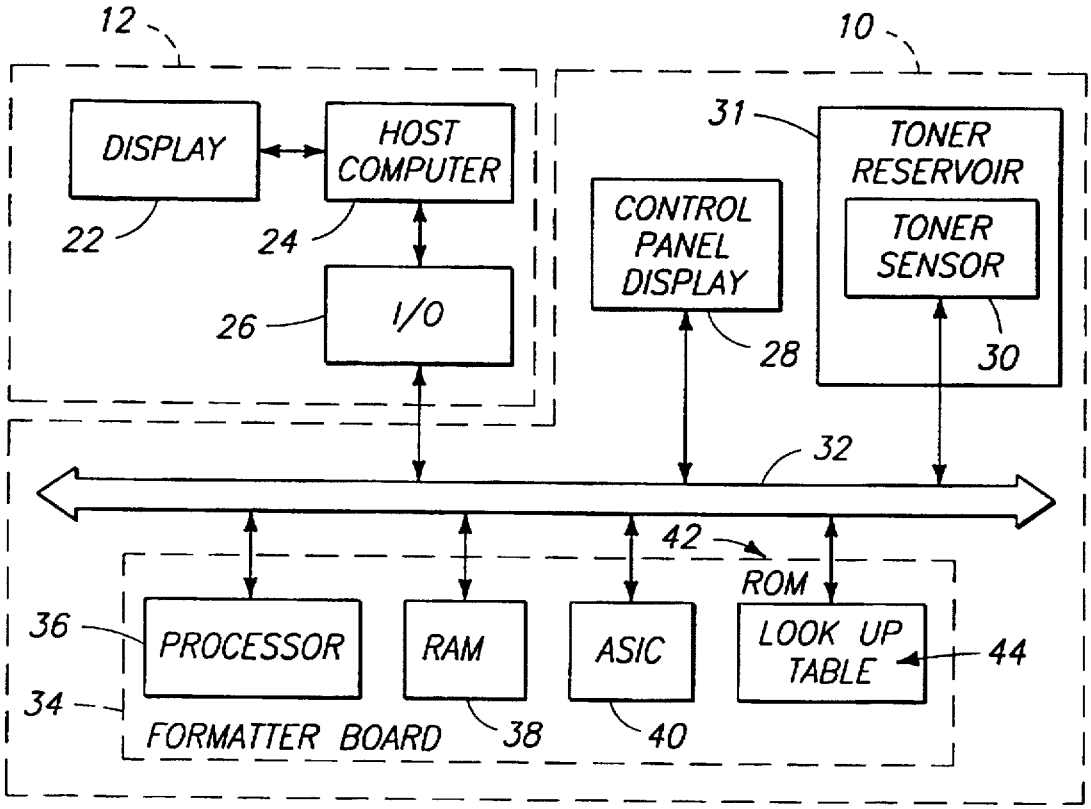
FIG. 2 is a block diagram illustrating in further detail various components of a computer and printer configured to implement the invention.

According to FIG. 2, computer 12 includes a display 22, a host computer 24 including a motherboard having a central processing unit (CPU) and memory, and an input/output (I/O) port 26. Computer 12 connects to printer 10 via a separate I/O port (not shown) of the printer and a bus 32. Preferably, the I/O connection is made with a cable capable of bidirectional, parallel communication, such as a BiTronics™ cable available from Hewlett-Packard. Bus 32 of printer 10 forms the internal control paths for communicating between devices of printer 10. For example, a control panel display 28, a toner sensor 30, a formatter board 34, and ROM 42 communicate via bus 32. Bus 32 includes a data bus, an address bus, a control bus, and a supply voltage from a power supply (not shown).

Formatter board 34 of FIG. 2 prepares printer 10 to communicate data with computer 12. Board 34 includes a processor 36, RAM 38, ASIC computer chip 40, and ROM 42. ROM 42 is used to store a look-up table 44 containing information about pixel information for a data stream defining particular print characteristics received from a print job of a computer 12. Optionally, look-up table 44 can contain information about laser modulation to achieve particular print characteristics, with each printer having its own calibration of toner use. For example, look-up table 44 can contain laser modulation information defining toner use such as half modulation, quarter modulation, etc. Additionally, or alternatively, look-up table 44 can be provided on ASIC 40.

In operation, formatter board 34 translates the Printer Control Language (PCL) code, taking the code and splitting it into different data streams. Typically, most of the printer memory is located on formatter board 34. The PCL code formats gray scale levels for a laser printer, via a binary data stream mode, or optionally, via a laser pulse modulation mode. Similarly, the PCL code formats the distribution of colors for a color printer.

As shown in FIG. 2, printer 10 includes a print engine (not shown) which forms the main working assembly. A print job is sent by computer 12 via I/O 26 to printer 10. The print job is sent from computer 12 to printer 10 in the form of a data stream. The data stream defines how many pixels, as well as the location of the pixels, within each page of a document to be printed. Accordingly, this pixel amount and location information is provided in the form of a pixel array that is mapped to each page to be printed.

A toner sensor 30 is provided for use with a toner reservoir 31 of printer 10 for coarsely, or roughly, detecting the toner level present within reservoir 31. Preferably, toner sensor 30 is an optical sensor formed by an array of emitters and detectors that measure incremental levels of toner present within toner reservoir 31. According to one construction, a reflective element is supported within toner reservoir 31, adjacent a viewing window. An array of light sources, or emitters, are provided outside of the toner cartridge and within a cavity in the printer that receives the cartridge, alongside the cartridge viewing window. Additionally, an array of detectors are provided adjacent to the array of emitters. Light passes from the emitters, through the window, and reflects off the reflective element. Reflected light then passes out the window to be detected by an associated detector, wherein the lack of a detected reflection indicates the presence of toner within the cartridge reservoir at that particular level since it obstructs the reflector. In this manner, toner can be detected at various elevational locations within toner reservoir 31, those emitters not visible with an associated detector being obscured with toner. The degree of obstruction of light from the emitters being detected with the detectors so as to indicate the toner level in increments. Optionally, a pair of windows can be provided in a toner cartridge, one at each end, with an array of elevationally positioned emitters supported outside the cartridge at one end, and an associated array of detectors positioned elevationally outside the other end of the cartridge.

According to another construction, a toner sensor 30 is provided completely within toner reservoir 31. For example, toner sensor 30 can be formed from an array of wire sensors, each wire sensor positioned at a unique elevational position within toner reservoir 31 for sensing the presence of toner at each respective level. Alternatively, a capacitive sensor can be used to approximately detect toner level remaining available for use by a printer.

According to the printer implementation, an electrophotographic printer utilizes a solid-state laser which scans across and exposes a photoconductor drum creating a latent image on the photoconductor drum. Subsequently, a powder toner cartridge deposits toner along the latent image of the drum. A toner cartridge of printer 10 delivers electrostatically charged powder toner particles (either black or colored) to a charged latent image on a photoconductor surface of a photoconductor drum, developing the photoconductor where the particles selectively adhere to appropriately charged regions. A charging corona, or optionally a charge transfer roller, charges the back side of a paper such that toner is transferred from the photoconductor drum to the paper where the paper and drum contact in the region of the charging corona. Subsequently, a fusing station thermally fuses the transferred powder toner to the paper. Finally, a cleaning station cleans any residual toner from the surface of photoconductor drum, enabling reinitiation of the cycle beginning with a process initiation point.

Especially for the case of mono component development as used in low-end printers, a toner cartridge forms a replaceable toner/developer cartridge which enables a user to replace toner when the cartridge has been emptied. The cartridge enables relatively quick and easy toner replacement by a user. Such a replaceable toner cartridge for use in a printer includes a cartridge housing preferably formed from plastic material. A separate memory can be provided on the toner cartridge for temporarily, or even permanently, storing information about toner levels detected by the sensor, as well as pixel count information used to describe print job characteristics of users. A toner supply reservoir is formed within the housing where a supply of powdered toner is stored for later use. A metering blade co-acts with a developer roll to deliver a metered amount of powdered toner along a developer roll where it is transferred to the surface of the photoconductor drum along charged regions. The developer roll preferably comprises a rotating toner/development roll having appropriate charging properties that are employed to charge the toner by way of touch and rubbing contacts. Accordingly, the toner electrostatically adheres to the roll along which it is transported to contact the photoconductor drum at the nip of the drum and roll. Optionally, the toner/development roll is separated from the photoconductor drum by a gap, the toner jumping the gap via charge jumping to transfer to the drum. In the presence of a charge-biased development field, delivered toner is selectively transferred to those areas of the photoconductor drum having an opposite sign charge.

Figure 3:
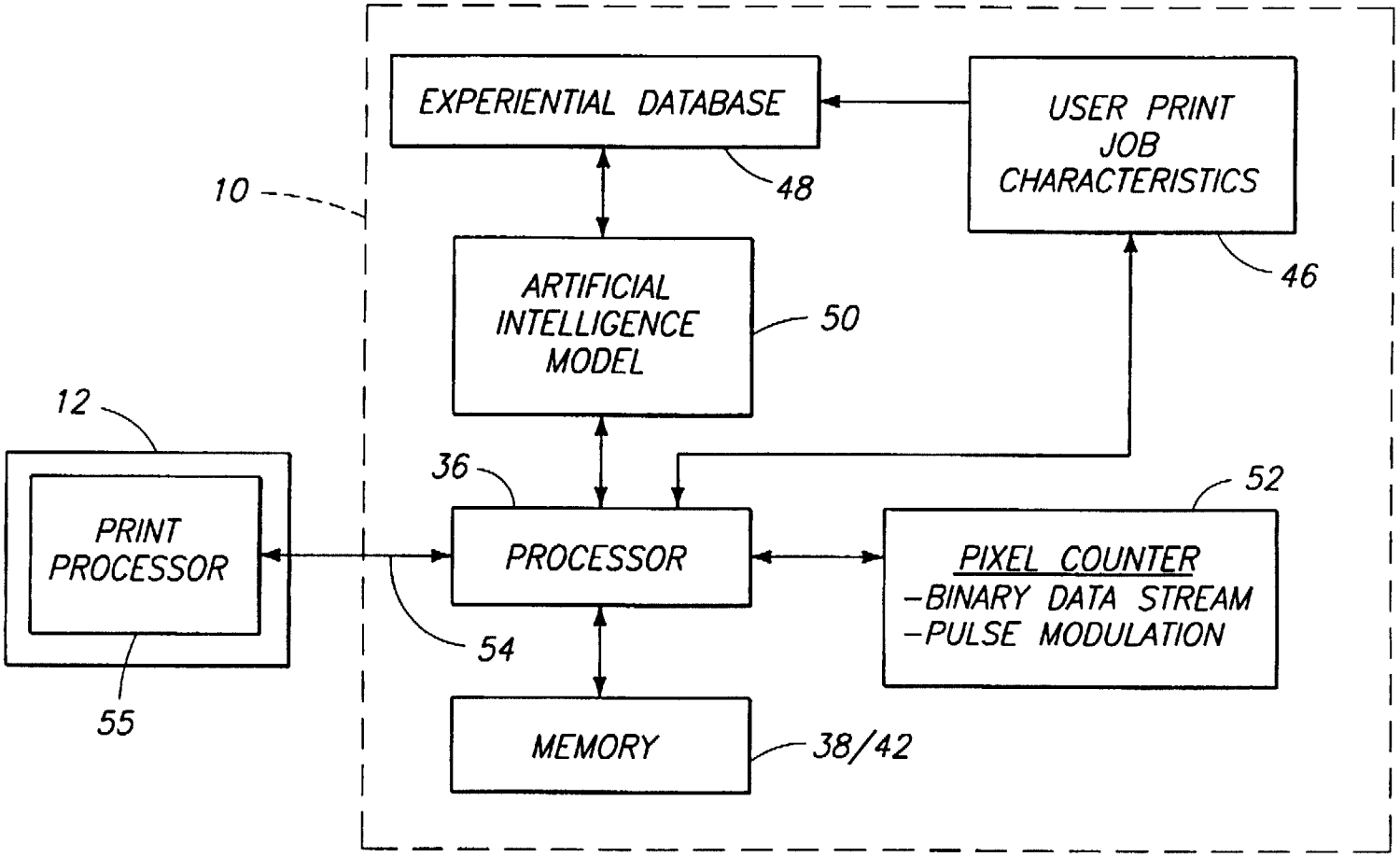
FIG. 3 is a block diagram showing the experiential database and pixel counting features employed according to one aspect of the invention.

FIG. 3 illustrates experiential database and pixel counting features employed by printer 10 and computer 12 according to this invention. More particularly, computer 12 employees a print processor on which the printer driver is implemented. Printer 10 is implemented via processor 36 and memory 38/42 to functionally implement the invention. User print job characteristics 46 comprise print job characteristics compiled from previous print jobs and/or user experiential print job data. An experiential database 48 is compiled over a period of use and time by users and/or computers indicating the print job characteristics for each user and/or computer. An artificial intelligence model then further combines information about characterized print jobs and/or users in order to make accurate estimates of toner level, and also make predictions about the toner level needed to carry out remaining and/or future print jobs. One simple artificial intelligence model merely adds up the pixel count information for each printed page and each user to arrive at an average, overall pixel count per printed page. Processor 36, user print job characteristics 46, experiential database 48 and artificial intelligence model 50 combine to form a toner level feedback system, with pixel counter 52 providing the source of experiential data for database 48, and print job characteristics 46.

Experiential database 48 can contain historical information about the number of pixels used per page of printed text/graphics as compiled from each print job implemented during the first 85% of the capacity of a toner cartridge. Alternatively, some other percentage of previous use can be used. For example, the first 50%, 60%, 70%, 80%, or some other percentage can be used in place of 85%, the choice being somewhat arbitrary based experientially upon what percentage of use actually works as a good predictor of pixel/toner use. Even further, usage from previous toner cartridges can also be used to collect such historical information. Such experiential data can then be used to make projections about how much toner will be used during the remaining 15% of capacity, or life, of a toner cartridge. For example, information about particular print jobs can be correlated with the source of the job in order to make predictions, and/or define trends, that predict the level of toner that will be needed to print jobs that will later be received from that particular job source during use of the remaining 15% of toner. For example, smart algorithms or artificial intelligence routines can be used. By combining the characterized toner use trends which have been collected over the initial 85% use of a toner cartridge, or from data collected during previous toner cartridge uses, predictions can be made about future use.

Artificial intelligence model 50, in a simplified implementation, can be formed as a set of simple algebraic equations that combine the toner use trends for each print job and/or user in the experiential database. For example, the average number of pixels used per page from print jobs emanating from a print processor 55 of a particularly user 12 can be monitored over the first 85% of use of a toner cartridge. In one case, the user can be an identified computer. In another case, the user can be identified as a person having an identifiable user ID. Model 50 can then note the frequency with which print jobs are received from this user 12, and predict the frequency of use by the user during the remaining 15% of cartridge use. The information learned from that user's print job characteristics 46, as collected in database 48 during the first 85% of use, as well as other user's print job characteristics, are then combined in the artificial intelligence model 50 to enable a more accurate prediction of toner use during the last 15% of cartridge use. For example, predictions can be made base on future print jobs based upon knowledge of which users print which type of job during a weekly, and/or hourly work schedule, then correlating the associated pixel user based on characterization of the print jobs submitted by the user to the printer.

Other print job characteristics can also be monitored such as the percentage of graphics versus text contained in print jobs emanating from a particular user. This information can be combined with knowledge about how many pixels are required to print each identified type of graphics page or text page. Even further, this information can be used to make predictions about pixel use required to produce a particular page having an identified combination of text and graphics. Yet even further, the particular pixel needs required to produce an identified type of graphics can also be monitored and stored in memory. Accordingly, predicted remaining printer capacity can be displayed to a user. For example, the remaining available pages capable of being printed on the printer by the toner cartridge can be displayed to users, either on the printer, or at a users computer display terminal.

A pixel counter 52 is implemented via processor 36 for counting pixels used to print each page, or sheet of paper, on printer 10. The results of pixel counter 52 are preferably used when constructing experiential database 48. Preferably, pixel counter 52 counts the pixels required to print a binary data stream defining each page being printed. Alternatively, pixel counter 52 counts the pixels required to print a mapped page being printed with toner pulse modulation wherein the number of pixels needed to print a feature varies depending on whether one-quarter, one-half, three-quarters, or full pulse modulation is used. A typical toner pulse modulation scheme has eight different degrees of pixel use. It is to be understood that black, white, gray levels and individual colors each form a particular toner hue wherein pixel values associated with the particular hue can be counted by the pixel counter.

Subsequently, pixel counter 52 is also used during the last 15% of use in order to render a more accurate visual output to a user indicating the remaining life of the toner cartridge. In one case, the number of available remaining pages to be printed can be calculated and displayed, using predictions from historical data collected and stored in database 48 about which users will submit jobs during the remaining 15% of use, and based upon historically-based predictions about the pixel-use required for that user's typical print jobs. Such predictive capabilities can be extended even further by historically monitoring and characterizing information about specific types of print jobs, each having a definable pixel use per page, and correlating it with trends based upon where the job emanated from, or at what time of day the job was submitted.

For example, it might be the case that large graphics print jobs are only submitted by a particular engineering department graphics computer terminal only on Tuesday evening, after 6 p.m. Perhaps, the particular user, or the engineering department manager, consciously sends these jobs on Tuesday evenings because of a policy to minimize system, or network, or printer slow down during normal office hours. Perhaps, the printed graphics output is needed for a weekly Wednesday morning meeting. A warning could be displayed to a user when sending a print job if the remaining available toner is not sufficient, based upon predicted user by the print job, to complete the job. Hence, a user could be warned if their large overnight print job will not be waiting for them when they return to work in the morning.

Whichever the case may be, armed with this information, printer 10 can combine such historical information for all users via artificial intelligence (AI) model 50 to make more accurate predictions about what level of toner remains within a toner cartridge, about that already detected by the toner sensor. This information can visually/audibly warn users as to when it predicts a toner cartridge will require changing, or additionally/alternatively, predict the remaining number of pages that can be printed from the toner cartridge.

Figure 4:
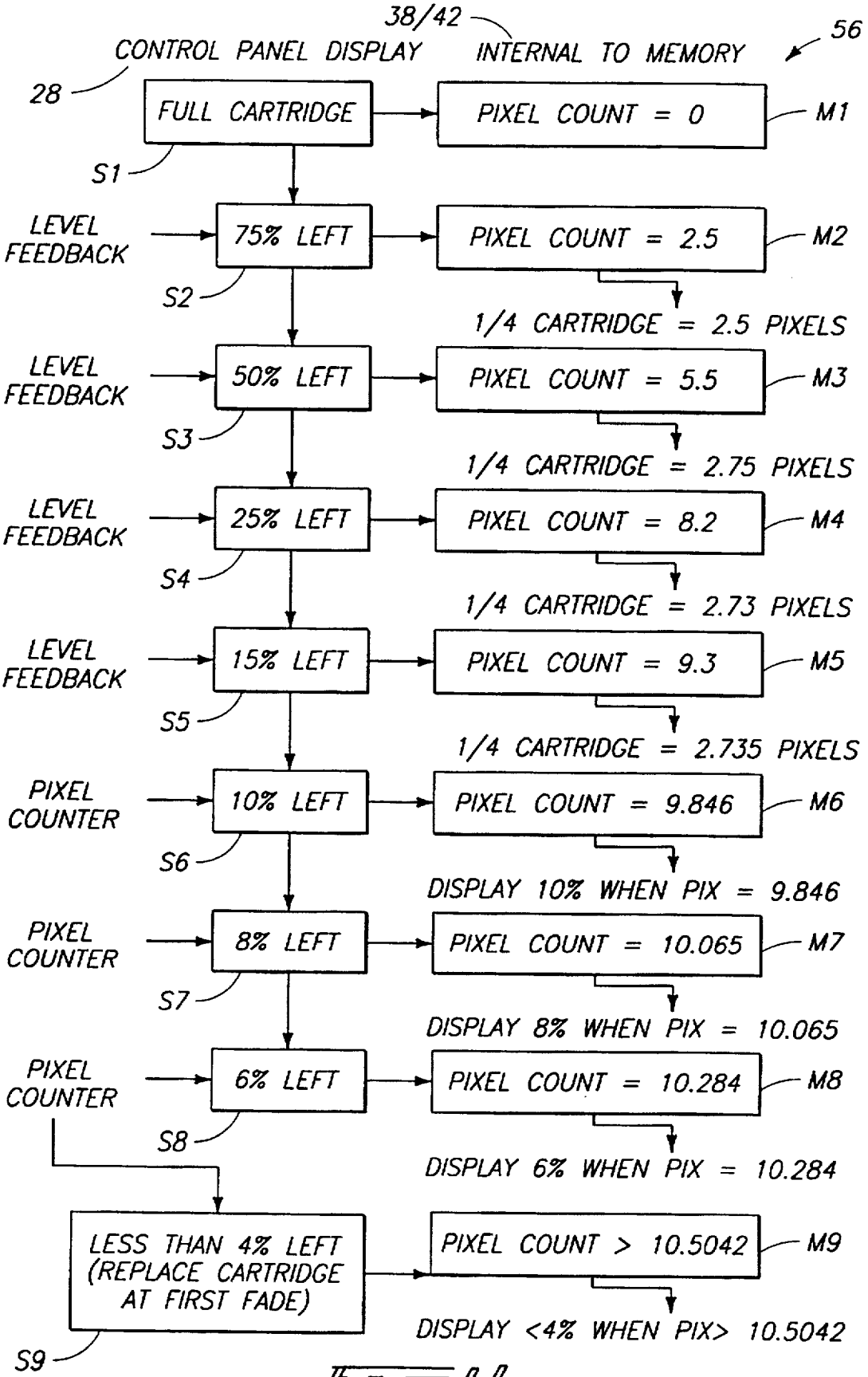
FIG. 4 is a high level logic flow diagram illustrating the enhanced toner level feedback system having pixel counting features in accordance with one aspect the invention.
Figure 11:
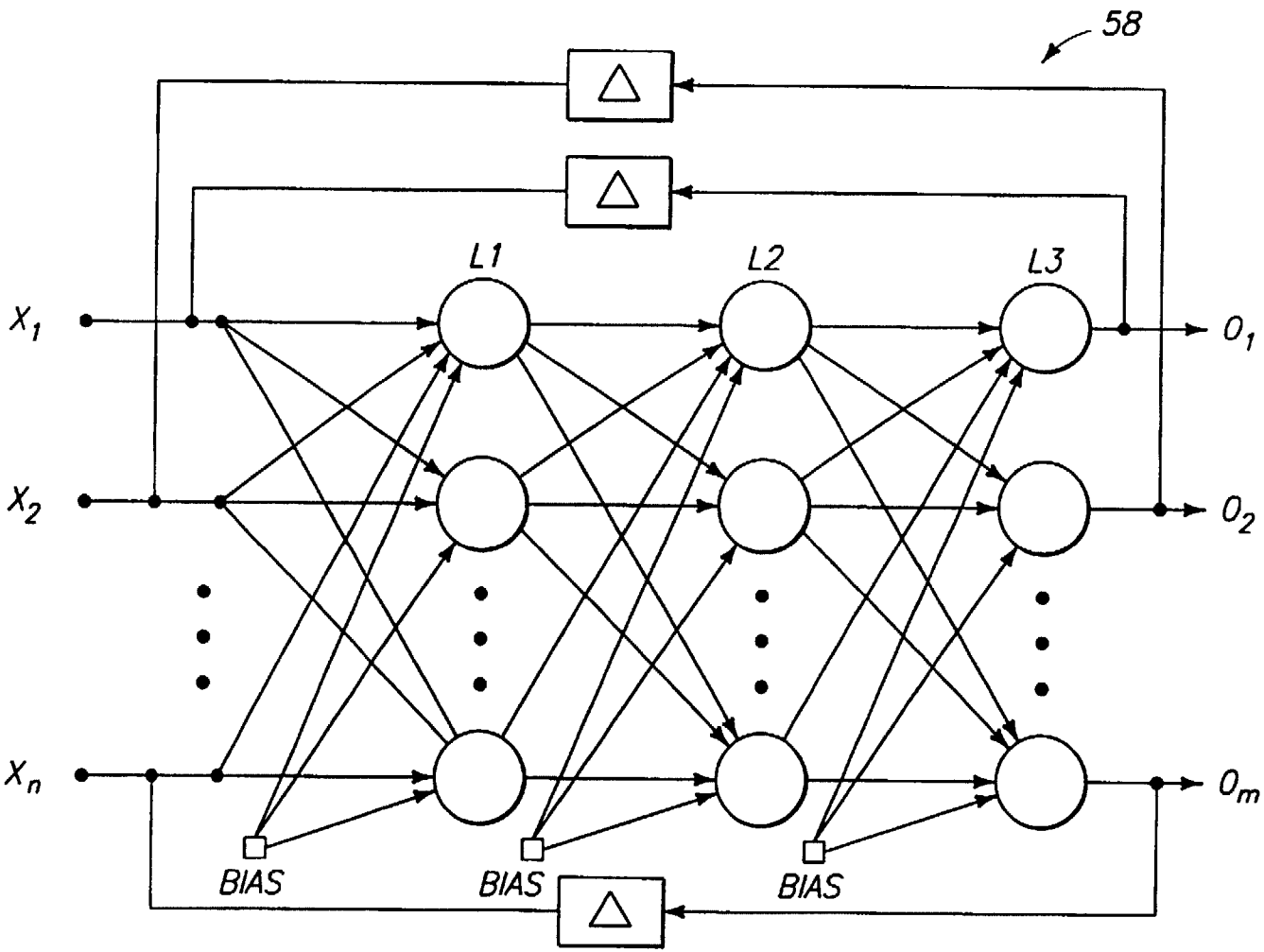

FIG. 4 illustrates an exemplary scenario for implementing the toner level feedback system of FIGS. 1–3. More particularly, the toner level feedback system is disclosed as a first level logic flow diagram for the programming of processor 36 (of FIG. 3). The feedback system forms a software routine for monitoring and displaying remaining levels of toner with increase accuracy during the final 15% of use remaining in a toner cartridge.

The logic flow diagram of FIG. 4 is initiated automatically in response to operation of printer 10 and is based upon the receipt of information about the level of toner remaining as sensed by toner sensor 30 (of FIG. 2). Additionally, pixel counter 52 provides information used to define print job characteristics experienced during the first 85% of use of the toner cartridge (of FIG. 3). Likewise, experiential database 48 collects data on these print job characteristics 46 over time in order to create a historical record of print job requirements for a particular user, enabling predictions of toner user for that user for the remaining 15% of cartridge use.

According to FIG. 4, the display steps (S1–S9) for visually displaying toner cartridge capacity are visually displayed to a user via control panel display 28 on printer 10 (see FIG. 2). Alternatively, the capacity can be displayed to users via display 22 of each computer 12. Pixel count values form a counting scheme 56 that is stored internally of memory 38/42, the respective values (M1–M9) corresponding to each display panel screen being depicted as stored in memory, immediately adjacent to the respective control panel display screen.

In Display Step "S1" of FIG. 4, the logic flow diagram is initiated with the loading of a full toner cartridge. The pixel count "M1" is initialized as 0. Toner sensor 30 (see FIG. 2) produces an output that is triggered when toner level is sensed at a 75% level, thereby initiating Display Step "S2". The pixel count "M2" is then monitored as being at a value of 2.5. The pixel count value is set at some arbitrary reference value based on a linear scale. Processor 36 then assigns to memory as experiential data in database 48 that a one-quarter cartridge use required a relative pixel value use of 2.5. After performing step "S2", the process proceeds to step "S3".

In step "S3", toner sensor 30 (of FIG. 2) produces an output that is triggered when toner level reaches the next detectable level change discernible by the sensor, that is a toner level of 50%. The pixel count "M3" is monitored to have a relative pixel count value of 5.5. Processor 36 (of FIG. 3) then assigns to memory as experiential data in database 48 the fact that the last one-quarter cartridge use of toner required a relative pixel value use of 2.75. After performing step "S3", the process proceeds to step "S4".

In step "S4", toner sensor 30 (of FIG. 2) produces an output that is triggered when toner level reaches the next detectable level change discernible by the sensor, that is a toner level of 25%. The pixel count "M4" is monitored to have a relative pixel count value of 8.2. Processor 36 (of FIG. 3) then assigns to memory as experiential data in database 48 the fact that the last one-quarter cartridge use of toner required a relative pixel value use of 2.73. After performing step "S4", the process proceeds to step "S5".

In step "S5", toner sensor 30 (of FIG. 2) produces an output that is triggered when toner level reaches the next detectable level change discernible by the sensor, that is a toner level of 15%. The pixel count "M5" is monitored to have a relative pixel count value of 9.3. Processor 36 (of FIG. 3) then assigns to memory as experiential data in database 48 the fact that the last one-quarter cartridge use of toner required a relative pixel value use of 2.735. After performing step "S5", the process proceeds to step "S6".

In step "S6", processor 36 uses the artificial intelligence model 50 (of FIG. 3) to count pixel use, based on the previously detected pixel use of 2.735 pixel values for a one-quarter cartridge use. More particularly, by counting pixels, and using the previously correlated toner use/pixel count information stored in memory location "M6", a new pixel count can trigger a display of 10% left at step "S6" when the pixel count reaches 9.846. Processor 36 (of FIG. 3) then assigns to memory in database 48 an updated pixel count 9.846. The occurrence of pixel count 9.846 then triggers processor 36 to display "10% LEFT", indicating an accurate prediction of available toner level within the toner cartridge to a user via display 28. After performing step "S6", the process proceeds to step "S7".

In step "S7", processor 36 uses the artificial intelligence model 50 (of FIG. 3) to count pixel use, based on the previously detected pixel use of 2.735 pixel values for a one-quarter cartridge use. More particularly, by counting pixels, and using the previously correlated toner use/pixel count information stored in memory location "M7", a new pixel count can trigger a display of 8% left at step "S6" when the pixel count reaches 10.065. Processor 36 (of FIG. 3) then assigns to memory in database 48 an updated pixel count 10.065. The occurrence of pixel count 10.065 then triggers processor 36 to display "8% LEFT", indicating an accurate prediction of available toner level within the toner cartridge to a user via display 28. After performing step "S7", the process proceeds to step "S8".

In step "S8", processor 36 uses the artificial intelligence model 50 (of FIG. 3) to count pixel use, based on the previously detected pixel use of 2.735 pixel values for a one-quarter cartridge use. More particularly, by counting pixels, and using the previously correlated toner use/pixel count information stored in memory location "M8", a new pixel count can trigger a display of 6% left at step "S6" when the pixel count reaches 10.284. Processor 36 (of FIG. 3) then assigns to memory in database 48 an updated pixel count 10.284. The occurrence of pixel count 10.284 then triggers processor 36 to display "6% LEFT", indicating an accurate prediction of available toner level within the toner cartridge to a user via display 28. After performing step "S8", the process proceeds to step "S9".

In step "S9", processor 36 uses the artificial intelligence model 50 (of FIG. 3) to count pixel use, based on the previously detected pixel use of 2.735 pixel values for a one-quarter cartridge use. More particularly, by counting pixels, and using the previously correlated toner use/pixel count information stored in memory location "M9", a new pixel count can trigger a display of less that 4% left at step "S9" when the pixel count reaches 10.5042. Processor 36 (of FIG. 3) then assigns to memory in database 48 an updated pixel count 10.5042. The occurrence of pixel count 10.284 then triggers processor 36 to display "LESS THAN 4% LEFT (REPLACE CARTRIDGE AT FIRST FADE)", indicating an accurate prediction of available toner level within the toner cartridge to a user via display 28. After performing step "S9", the process is completed.

FIG. 5 illustrates one suitable artificial intelligence (AI) model suitable for use in model 50 of FIG. 3. More particularly, model 50 is shown in the form of a neural network used as a projected print job pixel use classification mechanism for projecting more accurately the remaining toner within a toner cartridge during use of the cartridge late in its life. The projection is based on the user print job characteristics for a pool of multiple users. Previously collected historical information on pixel use per print job by user is tabulated so as to enable its later use in order to supplement toner level information detected by a toner sensor having only a rough ability to detect changes in toner level (e.g., only toner level changes on the order of "full", "74% remaining", "50% remaining", "25% remaining", and "15% remaining".

According to the neural network implementation of FIG. 5, an array of print job characteristics vectors are provided for each user, descriptive of number of pixels needed to print a job. These vectors are fed to the input layer of neurons of the neural network pixel count print job classifier, which forms a type of multilayer perceptron. According to the implementation depicted in FIG. 5, the neural network object classifier consists of a three layer, backpropagation network, having input layer, $x_1$–$x_2$, consisting of one neuron for each of n features, a hidden layer consisting of n neurons, and an output layer consisting of one neuron for each of m output classes, $O^1$–$O_m$, corresponding to the m classes into which each object will be classified. The neurons will preferably possess a non-linear, sigmoidal activation function. Such a backpropagation network is an established design wherein the backpropagation of error signals from the output layer is used to adjust the synaptic weights of input and hidden layers.

By presenting a series of sets of input patterns, $x_1, x_2, x_3, \ldots x_n$, a forward propagation of signals is triggered through the neural network which results in a set of output values, $O_1, O_2, O_3, \ldots O_m$, corresponding to each of the m possible control panel display messages, S1–S9. During learning, the error between the output values, $O_1, O_2, O_3, \ldots O_m$, is backpropagated through the neural network to adjust synaptic weights on the neurons in such a way that, as the training series of input patterns is presented to the network, the synaptic weights converge to stable values that result in correct classification of input values, $x_1, x_2, x_3, \ldots x_n$, presented to the input layer. Hence, the error backpropagated through the neural network is thus minimized.

It is understood that such backpropagation networks are well established, and some are available in commercial form, as hardware, software, or hardware/software hybrids such as NeuralWorks™ Professional II/Plus from NeuralWare of Pittsburgh, Pa. An important benefit of backpropagation networks is their ability to generalize. They do not have to be presented with every possible input pattern during the training of the neural network.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A toner level detecting system, comprising:

an image forming apparatus having a toner reservoir;

a toner sensor having a toner sensing element positioned to detect toner amount within the toner reservoir;

a pixel counter configured to count pixels used when forming images; and a processor associating counted pixels with previous toner use, the associated counted pixels and previous toner use enabling enhanced toner level characterization of remaining available toner level.

2. The toner level detecting system of claim 1 wherein the pixel counter is configured to count pixel values comprising a particular toner hue.

3. The toner level detecting system of claim 1 wherein the pixel counter is configured to count a plurality of toner hues.

4. The toner level detecting system of claim 1 further comprising a data management system comprising the processor, memory, an experiential database of user print job characteristics, and an artificial intelligence model, the toner sensor providing a toner level feedback usable to calibrate detected pixel count toner usage.

5. The toner level detecting system of claim 1 further comprising an experiential database of user print job characteristics associating counted pixels with categorized print jobs.

6. The toner level detecting system of claim 5 wherein the print jobs are categorized by the source from which the print job was received.

7. The toner level detecting system of claim 1 further comprising an artificial intelligence model configured to learn individual print job characteristics of each user usable to quantify toner usage.

8. The toner level detecting system of claim 7 wherein the artificial intelligence model comprises a neural network model configured to project print job pixel use, the projected use enabling projection of future print job capabilities based upon detected toner amount and projected use.

9. The toner level detecting system of claim 1 further comprising a control panel display of the printer usable to display the characterized remaining available toner level.

10. The toner level detecting system of claim 1 further comprising a display of a computer used to send a print job request to the printer.

11. The toner level detecting system of claim 1 wherein the toner level detecting system is implemented within a computer network environment.

12. A printing device, comprising:

an electrostatic image carrying device for carrying a latent image;

a developing unit for developing the latent image;

a toner supply reservoir for supplying a toner;

a toner level detecting system comprising an image forming apparatus having a toner reservoir; a toner sensor having a toner sensing element positioned to detect toner amount within the toner reservoir; a pixel counter configured to count pixels used when forming images; and a processor associating counted pixels with previous toner use, the associated counted pixels and previous toner use enabling enhanced toner level characterization of remaining available toner level.

13. The printing device of claim 12 further comprising a data management system comprising the processor, memory, an experiential database of user print job characteristics, and an artificial intelligence model, the toner sensor providing a toner level feedback usable to calibrate detected pixel count toner usage.

14. The printing device of claim 12 further comprising an experiential database of user print job characteristics associating counted pixels with categorized print jobs.

15. The printing device of claim 12 further comprising an artificial intelligence model configured to learn individual print job characteristics of each user usable to quantify toner usage.

16. A method for detecting toner level within a toner reservoir of an image forming device, comprising the steps of:

providing a toner sensor within a toner reservoir of an image forming apparatus;

incrementally detecting toner amount within the toner reservoir via the toner sensor;

counting pixels used to form images with a determined amount of toner removed from the toner reservoir; and calculating toner amount by adjusting the incrementally detected toner amount with an estimated amount of removed toner based at least in part on the number of counted pixels.

17. The method of claim 16 further comprising the step of displaying the calculated toner amount.

18. The method of claim 16 further comprising the step of storing a binary data stream used to form an image in memory, pixels of the binary data stream being counted.

19. The method of claim 16 further comprising the step of storing a laser pulse modulation stream used to form an image in memory, pixels of the laser pulse modulation stream being counted.

20. The method of claim 16 wherein the image comprises a gray scale image.

* * * * *